US006041990A

United States Patent [19]

Chang

[11] Patent Number: 6,041,990

[45] Date of Patent: Mar. 28, 2000

[54] FORGING MACHINE FEEDING MECHANISM WITH A RECIPROCATING SECTOR DRIVING GEAR, SECTOR DRIVEN GEARS WHICH ARE CONNECTED TO THE FEED ROLLERS THROUGH A SHAFT, AND A CIRCUMFERENTIAL BRAKE ON THE FEED ROLLERS

[75] Inventor: Yun-Te Chang, Tainan, Taiwan

[73] Assignee: FWU Kuang Enterprises Co., Ltd., Taiwan

[21] Appl. No.: 09/336,249

[22] Filed: Jun. 18, 1999

[51] Int. Cl.[7] ..... B65H 23/06

[52] U.S. Cl. ..... 226/144; 226/148; 74/142; 74/665 GA

[58] Field of Search ..... 242/144, 146, 242/147, 148, 156, 188; 74/142, 665 GA, 810.1

[56] References Cited

U.S. PATENT DOCUMENTS

| | | | |
|---|---|---|---|
| 1,776,899 | 9/1930 | Hagemann | 226/156 X |
| 1,937,675 | 12/1933 | Twomley | 226/156 X |
| 2,110,228 | 3/1938 | Lakeman et al. | 226/144 X |
| 2,317,481 | 4/1943 | Peterson et al. | 226/156 X |
| 2,389,929 | 11/1945 | Paulsen et al. | 226/144 X |
| 2,547,828 | 4/1951 | Maussnest | 226/144 |
| 2,998,760 | 9/1961 | Allen | 226/244 X |
| 3,517,872 | 6/1970 | Chmela | 226/156 X |
| 3,838,761 | 10/1974 | Hakansson et al. | 226/148 X |
| 4,469,291 | 9/1984 | Treiber et al. . | |

FOREIGN PATENT DOCUMENTS 581047 8/1959 Canada .

*Primary Examiner*—Donald P. Walsh
*Assistant Examiner*—Collin Webb
*Attorney, Agent, or Firm*—Trop, Pruner & Hu, P.C.

[57] ABSTRACT

A feeding mechanism for a forging machine includes a roller unit consisting of a pair of feeding rollers. Two rotating shafts are connected respectively and fixedly to the feeding rollers at an end portion, and to outer and inner driven gears at the other end portion. The inner and outer driven gears mesh with each other. A driving gear meshes with the inner driven gear, and rotates reciprocally within a predetermined angular range. The driving gear and the outer driven gear are sector gears. Each of the inner and outer driven gears is mounted on the corresponding rotating shaft by means of a unidirectional bearing so as to convert reciprocal rotation of the driving gear into intermittent unidirectional rotation of each of the rollers. Each of the rollers is provided with a braking member, which includes a circumferentially extending brake plate that presses against an outer periphery of the corresponding roller.

2 Claims, 8 Drawing Sheets

FORGING MACHINE FEEDING MECHANISM WITH A RECIPROCATING SECTOR DRIVING GEAR, SECTOR DRIVEN GEARS WHICH ARE CONNECTED TO THE FEED ROLLERS THROUGH A SHAFT, AND A CIRCUMFERENTIAL BRAKE ON THE FEED ROLLERS

BACKGROUND OF THE INVENTION

1. Field of the Invention

This invention relates to a forging machine, more particularly to a feeding mechanism for a forging machine, which feeds an elongated blank to be forged.

2. Description of the Related Art

In the art of manufacturing nuts or bolts, a feeding mechanism is provided on a forging machine for feeding an elongated blank to be forged prior to thread formation. Referring to FIG. 1, a conventional feeding mechanism 1 is shown to include a machine frame 110, and two roller units, each of which consists of a pair of upper and lower feeding rollers 11 for clamping and moving an elongated blank 10 therebetween. Referring to FIGS. 2, 3 and 4, each of the rollers 11 is provided coaxially with a fixed rotating shaft 111, which is journalled on the machine frame 110 by means of bearings 112 and which is connected coaxially and fixedly to a driven gear 13. Upper driven gears 13 mesh with lower driven gears 13, respectively. A driving member 14 includes a driving gear 141 and a ratchet wheel 142, which are connected coaxially and fixedly with each other. The driving gear 141 is provided coaxially with a fixed rotating shaft 140, which is journalled on the machine frame 110. A swing arm 15 is sleeved rotatably on the rotating shaft 140 at an upper end thereof, and is connected pivotally to a left end of a push-pull rod 16 at a lower end thereof. A right end of the push-pull rod 16 is connected rotatably to a crank pin 180 of a crank member 18, which has a crank shaft 181. When the swing arm 15 is swung by the push-pull rod 16 to rotate the driving member 14, a linkage 151 presses intermittently a pawl member 152 against a toothed outer periphery of the ratchet wheel 142 so as to rotate the ratchet wheel 142 counterclockwise and intermittently, thereby permitting intermittent unidirectional rotation of the driving gear 141 on the machine frame 110 and each of the rollers 11. The blank 10 is fed a predetermined distance at each time, in which the swing arm 15 effects a swinging cycle. The predetermined distance depends on the distance between the crank shaft 181 and the crank pin 180. A braking member 143 is mounted on the machine frame 110, and has a circumferentially extending brake plate 144, which presses against an outer periphery of the rotating shaft 140 for preventing untimely rotation of the rotating shaft 140 on the machine frame 110. A relatively large force to drive the push-pull rod 16 is required to overcome the gripping force of the braking member 143 on the rotating shaft 140 and to rotate the rollers 11, the driven gears 13, the driving gear 141, the ratchet wheel 142, the swing arm 15, and the linkage 151. As a result, it is difficult to start and stop the rotation of the driving member 14. As such, the brake plate 144 wears easily so that the pawl member 152 engages a tooth of the ratchet wheel 142 at a point 148, thereby subsequently sliding to a point 149, in which the pawl member 152 can push a tooth of the ratchet wheel 142 to rotate counterclockwise, as shown in FIG. 5. This sliding movement of the pawl member 152 generates noise, and affects adversely the quality of the forged products in view of the condition that the distance of the blank 10, which is fed by the feeding mechanism 1 is uneven.

SUMMARY OF THE INVENTION

The object of this invention is to provide a feeding mechanism for a forging machine, which has a durable baking member and which generates little noise that is caused by the movements of the parts of the feeding mechanism.

According to this invention, a feeding mechanism for a forging machine includes a roller unit consisting of a pair of feeding rollers. Two rotating shafts are connected respectively and fixedly to the rollers at an end portion, and to inner and outer driven gears at the other end portion. The inner and outer driven gears mesh with each other. A driving gear meshes with the inner driven gear, and rotates reciprocally within a predetermined angular range. The driving gear and the outer driven gear are sector gears. Each of the inner and outer driven gears is mounted on the corresponding rotating shaft by means of a unidirectional bearing so as to convert reciprocal rotation of the driving gear into intermittent unidirectional rotation of each of the rollers. Each of the rollers is provided with a braking member, which includes a circumferentially extending brake plate that presses against an outer periphery of the corresponding roller. Because the driving gear and the outer driven gear are sector gears so as to reduce the weight of these gears, and because the braking members are mounted respectively on the rollers, the driving gear can be driven easily, thereby reducing wearing of the braking members. Furthermore, the unidirectional bearings generate little noise.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 6:
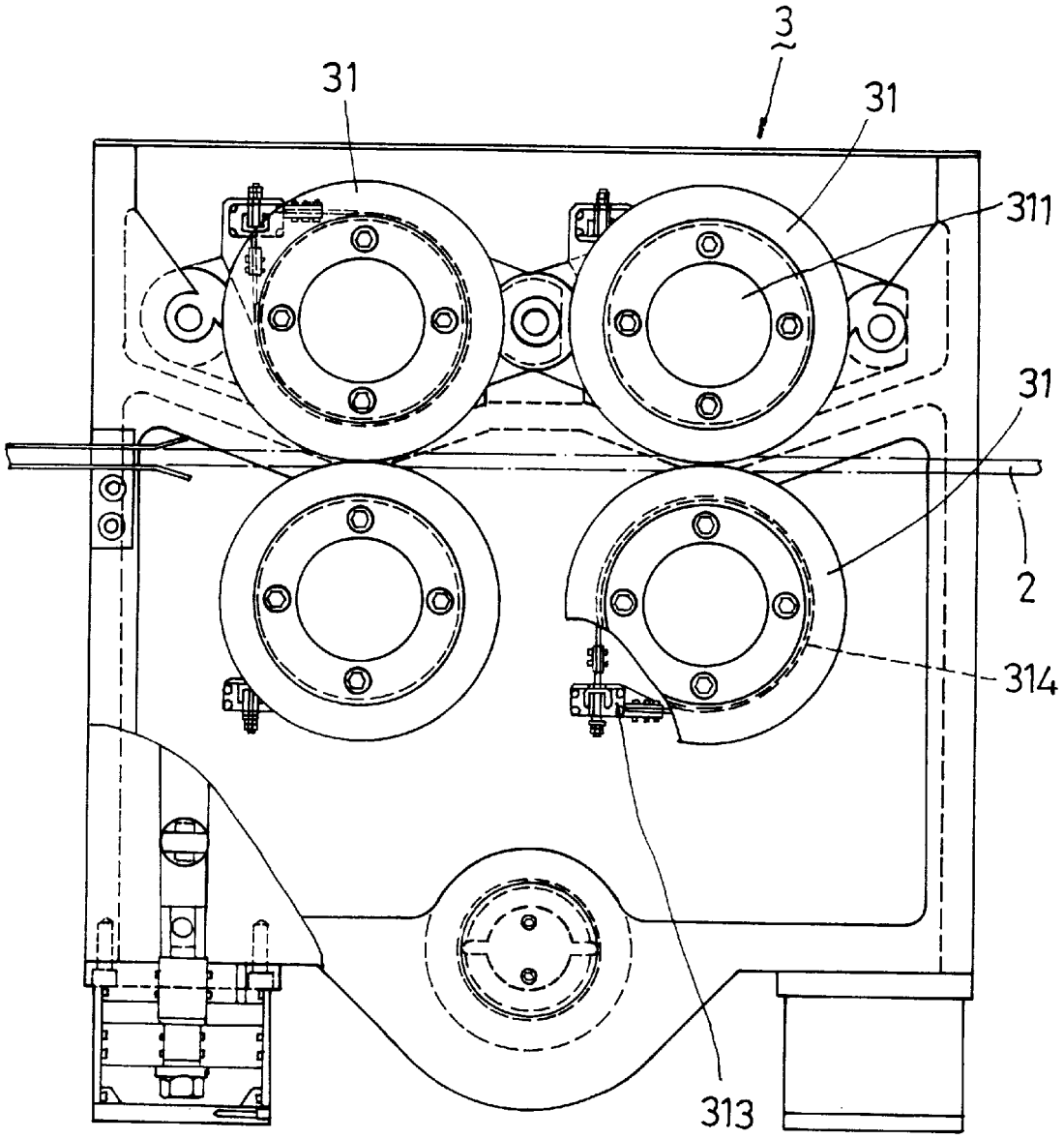
FIG. 6 is a schematic front view of the preferred embodiment of a feeding mechanism for a forging machine according to this invention.
Figure 7:
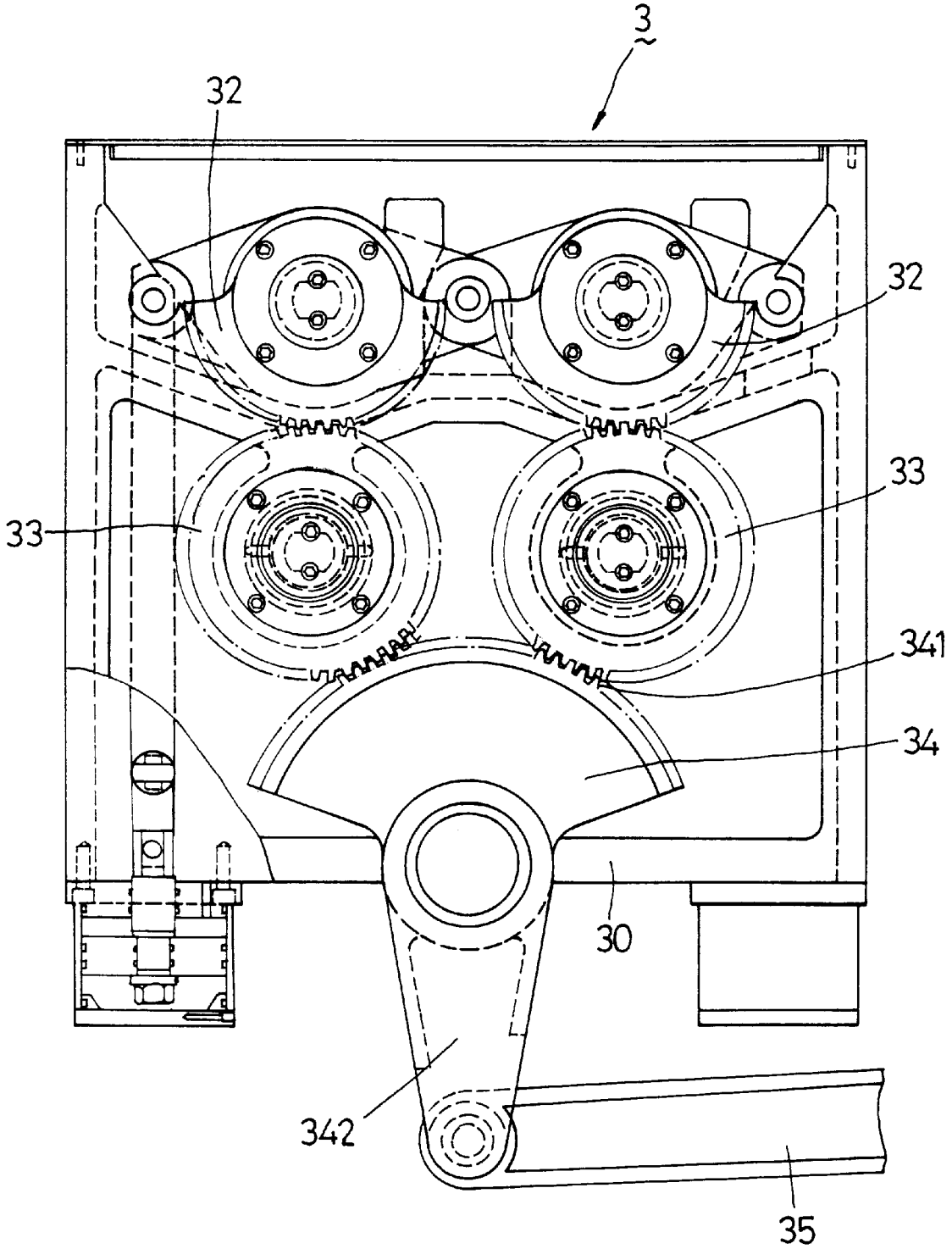
FIG. 7 is a schematic rear view of the preferred embodiment.
Figure 8:
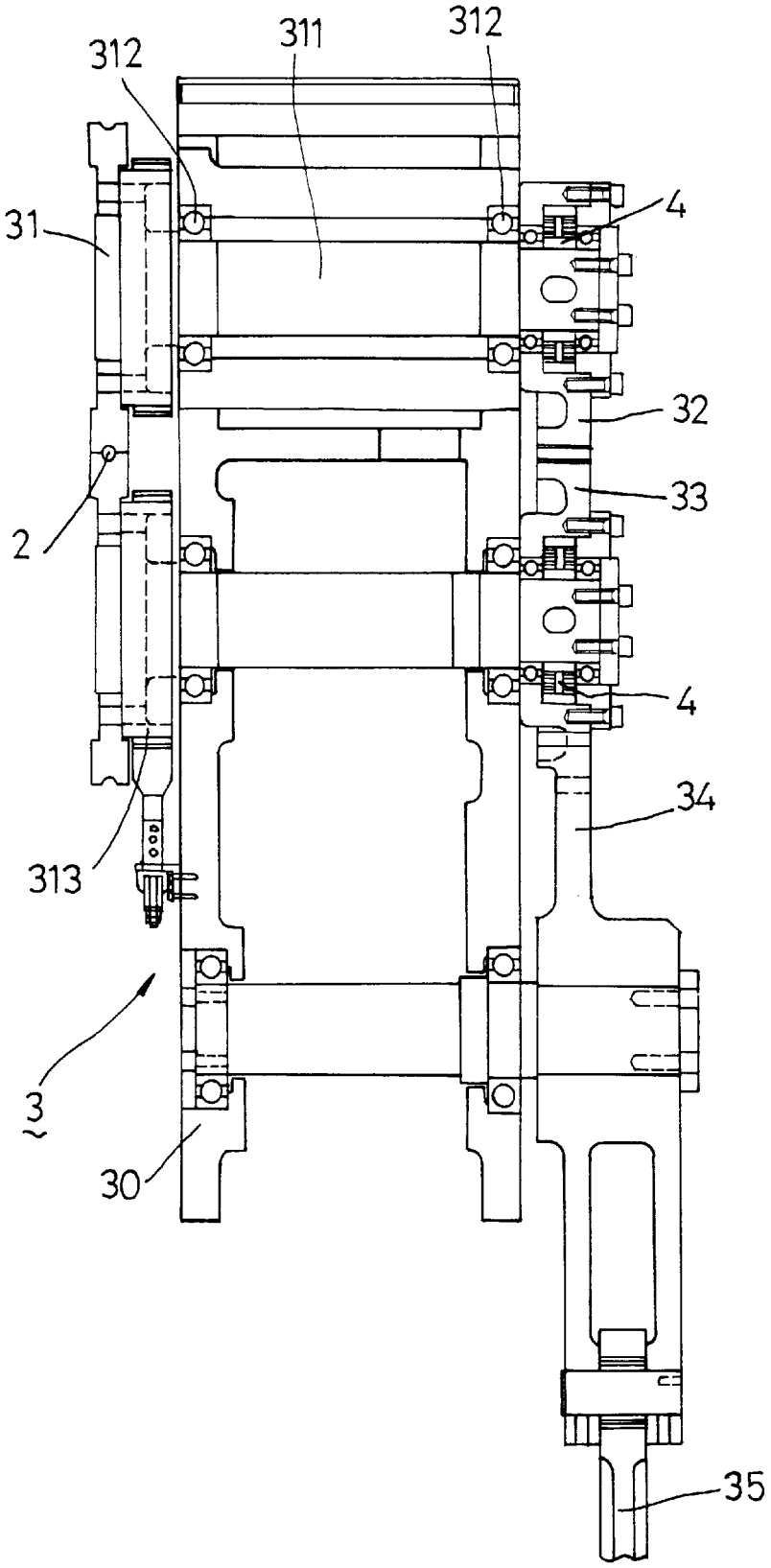
FIG. 8 is a schematic left side view of the preferred embodiment.

Referring to FIGS. 6, 7 and 8, the preferred embodiment of a feeding mechanism 3 for a forging machine is shown. The feeding mechanism 3 includes a machine frame 30, two roller units, each of which consists of an upper feeding roller 31 and a lower feeding roller 31 for clamping and moving an elongated blank 2 therebetween, two outer driven gears 32, two inner driven gears 33, a driving gear 34, and a push-pull rod 35.

Four rotating shafts 311 are journalled on the machine frame 30 by bearings 312, and have front ends that are connected respectively and fixedly to the four feeding rollers 31, and rear ends that are connected respectively and fixedly to the outer and inner driven gears 32, 33. Each of the outer and inner driven gears 32, 33 is mounted on the corresponding rotating shaft 311 by means of a unidirectional bearing or rotational-direction converting unit 4.

The outer driven gears 32 mesh with the inner driven gears 33, respectively. The driving gear 34 is mounted rotatably on the machine frame 30, and has a toothed outer periphery 341, which meshes with the inner driven gears 33. A swing arm 342 is connected fixedly to the driving gear 34 at one end, and is connected pivotally to an end of a push-pull rod 35, which is driven by means of a crank member (not shown) in a known manner.

When the swing arm 342 is swung by the push-pull rod 35, the driving gear 34 rotates the outer and inner driven gears 32, 33 reciprocally. Because the unidirectional bearings 4 are interposed between the rotating shaft 311 and the outer and inner driven gears 32, 33, reciprocal rotation of each of the outer and inner driven gears 32, 33 is converted into intermittent unidirectional rotation of the corresponding rotating shaft 311 and the corresponding roller 31. Each of the rollers 31 is provided with a braking member 313, which includes a circumferentially extending brake plate 314 that presses against an outer periphery of the corresponding roller 31.

Figure 1:
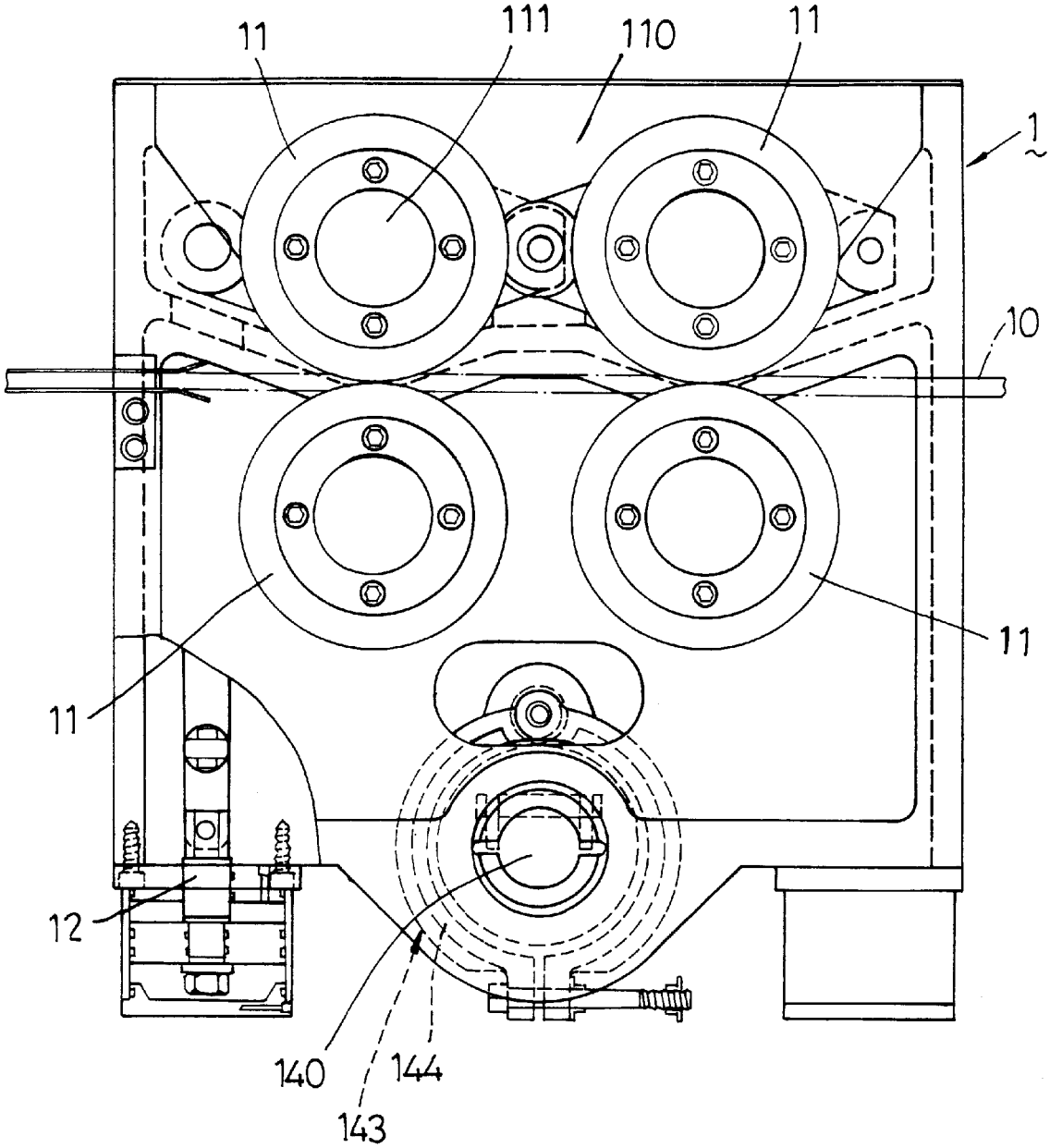
FIG. 1 PRIOR ART
FIG. 1 is a schematic front view of a conventional feeding mechanism for a forging machine.
Figure 2:
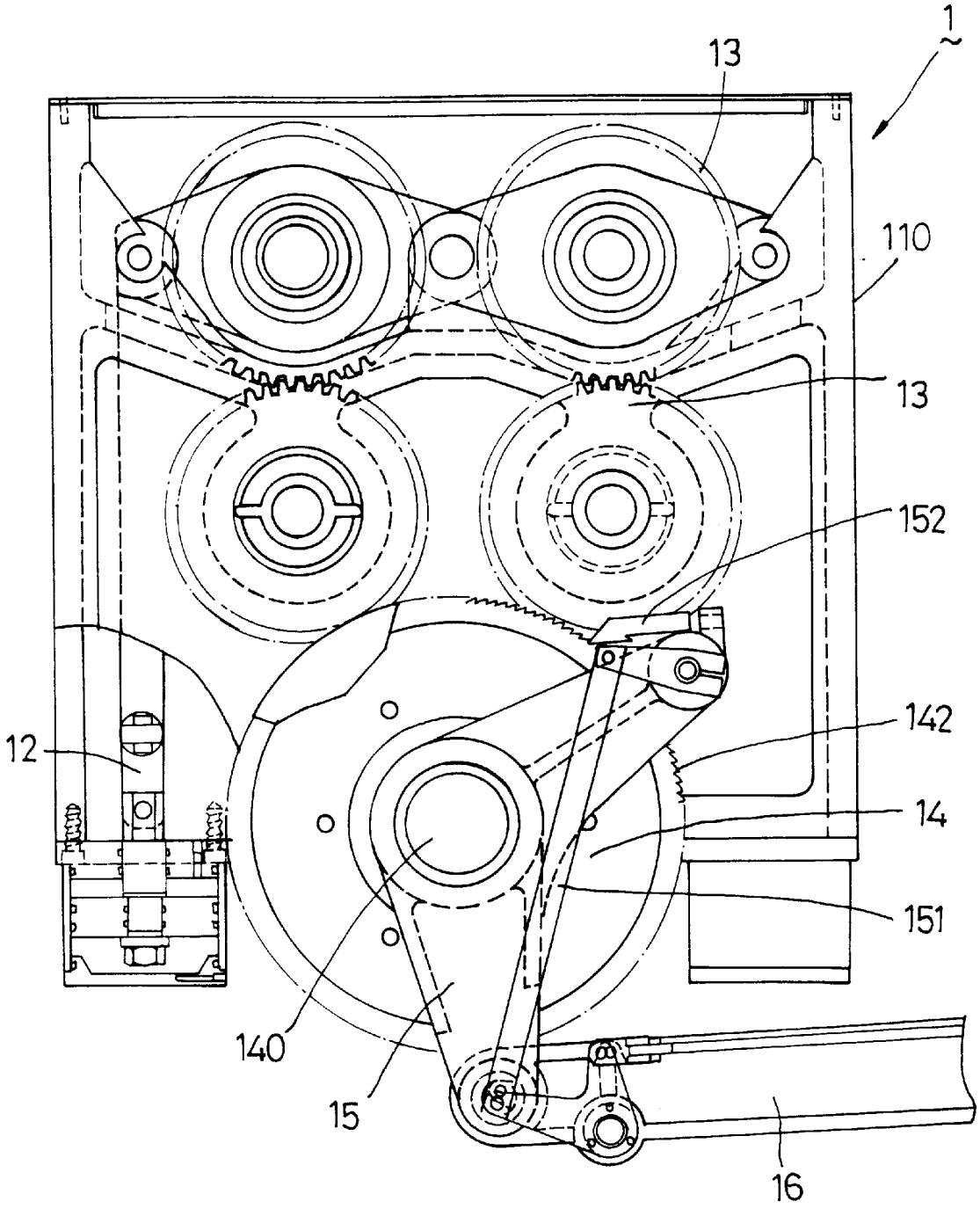
FIG. 2 PRIOR ART
FIG. 2 is a schematic rear view of the conventional feeding mechanism.
Figure 3:
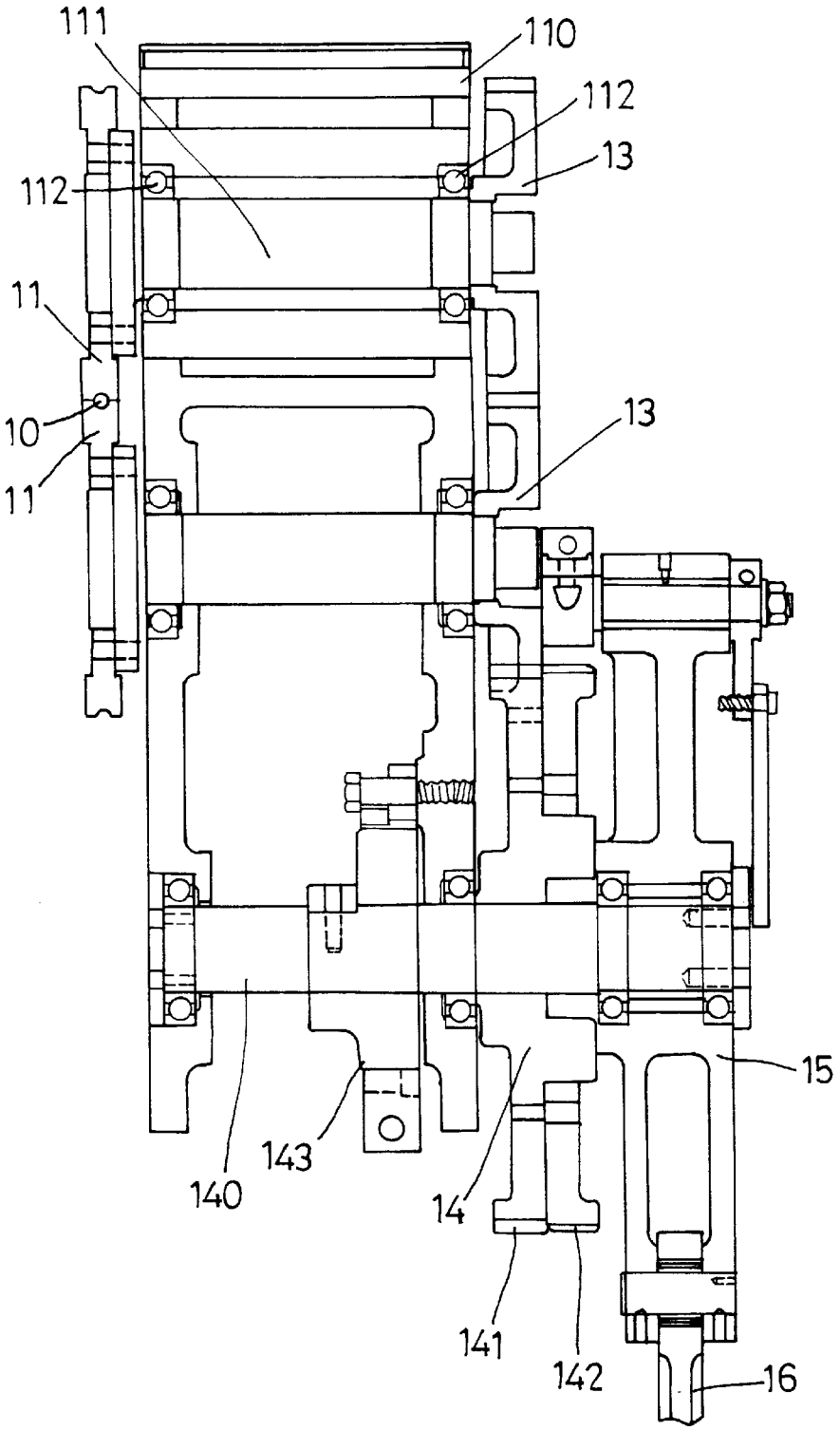
FIG. 3 PRIOR ART
FIG. 3 is a schematic left side view of the conventional feeding mechanism.
Figure 4:
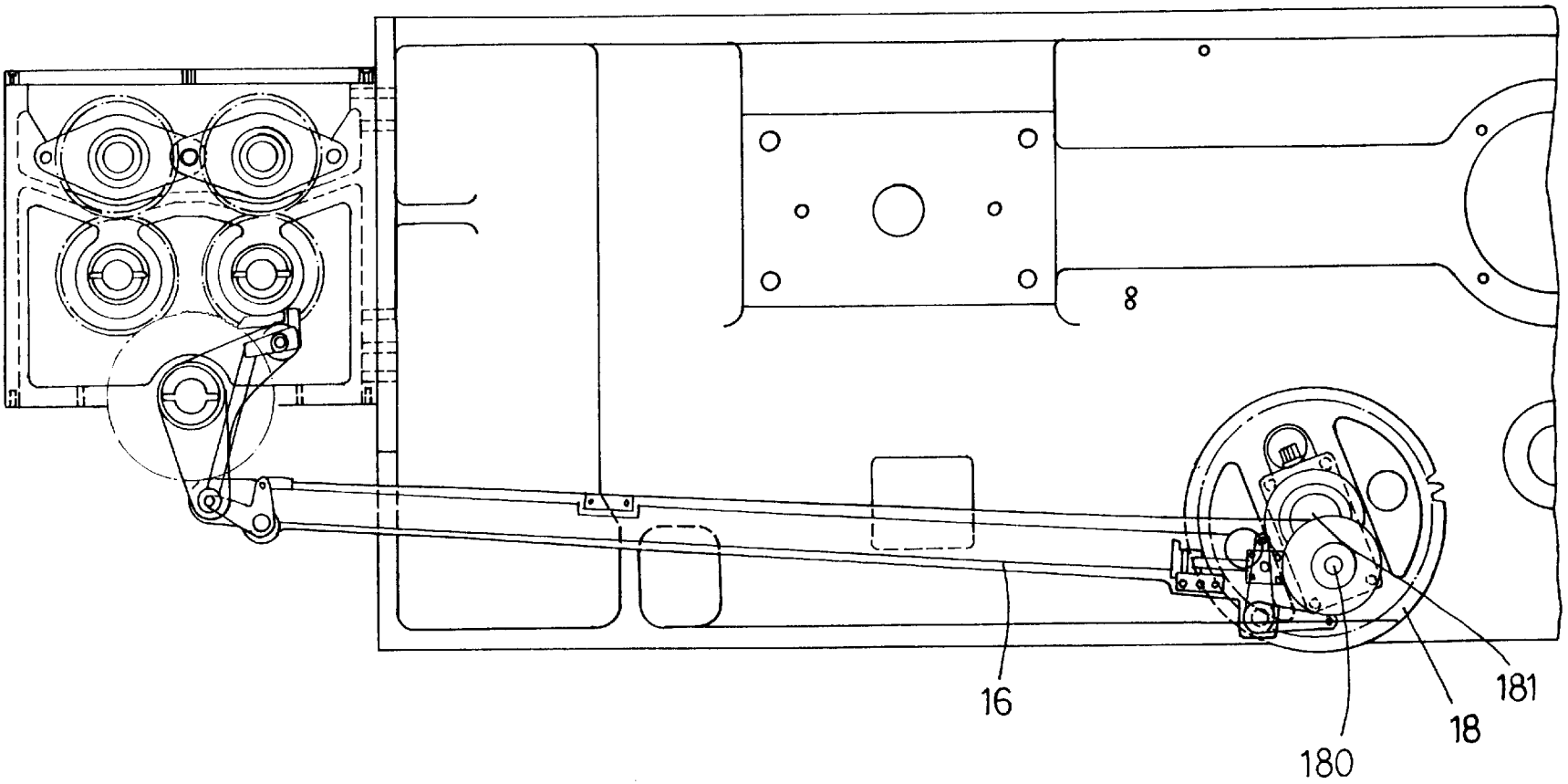
FIG. 4 PRIOR ART
FIG. 4 is a schematic rear view illustrating how the conventional feeding mechanism is driven by means of a crank member.
Figure 5:
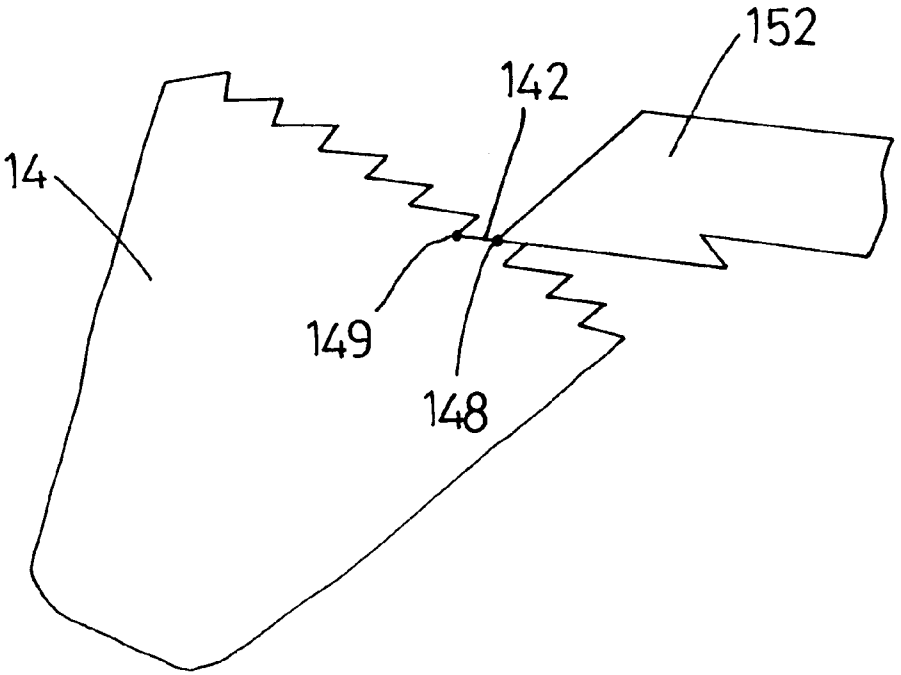
FIG. 5 PRIOR ART
FIG. 5 is a schematic rear view illustrating how a ratchet wheel of the conventional feeding mechanism is driven by means of a pawl member.

Because the outer driven gears 32 and the driving gearing 34 are sector gears, which are lighter than the upper driven gears 13 (see FIG. 2) and the driving member 14 (see FIG. 2) of the conventional feeding mechanism 1 (see FIG. 2), the rotation of the rollers 31 can be easily started and stopped, thereby reducing wearing of the brake plate 314 and increasing productivity of the forged machine. Accordingly, the blank 2 can be fed accurately a predetermined distance.

With this invention thus explained, it is apparent that numerous modifications and variations can be made without departing from the scope and spirit of this invention. It is therefore intended that this invention be limited only as indicated in the appended claims.

I claim:

1. A feeding mechanism for a forging machine, said feeding mechanism being adapted to feed an elongated blank and including:

a machine frame;

a roller unit including a pair of feeding rollers adapted to clamp and move the blank therebetween;

two rotating shafts that are connected respectively and fixedly to said rollers and that are journalled on said machine frame;

an outer driven gear;

an inner driven gear meshing with said outer driven gear, said inner and outer driven gears being disposed respectively on said rotating shafts;

a driving gear meshing with said inner driven gear to rotate said inner and outer driven gears, said driving gear rotating reciprocally within a predetermined angular range; and a rotational-direction converting unit for converting reciprocal rotation of said driving gear to intermittent unidirectional rotation of said rollers;

wherein the improvement comprises:

said driving gear and said outer driven gear are sector gears, said rotational-direction converting unit including four unidirectional bearings, which are mounted respectively on said rotating shafts, each of said bearings being disposed between a corresponding one of said rotating shafts and a corresponding one of said inner and outer driven gears, thereby converting reciprocal rotation of said inner and outer driven gear into intermittent unidirectional rotation of said rollers.

2. A feeding mechanism as claimed in claim 1, wherein each of said rollers is provided with a braking member, which includes a circumferentially extending brake plate that presses against an outer periphery of a corresponding one of said rollers.

* * * * *